US005518250A

United States Patent [19]

Lu et al.

[11] Patent Number: 5,518,250

[45] Date of Patent: May 21, 1996

[54] DART BOARD ASSEMBLY

[76] Inventors: Kuo-Hui Lu, 3F, No. 50, Lane 2, Sec. 2, Yan Jiow Yuann Rd.; Chin-Huang Peng, 4-4F, No. 31, Sun Chang Rd., both of Taipei, Taiwan

[21] Appl. No.: 441,745

[22] Filed: May 16, 1995

[51] Int. Cl.[6] ..... F41J 3/00

[52] U.S. Cl. ..... 273/347; 273/376

[58] Field of Search ..... 273/371–377, 273/347

[56] References Cited

U.S. PATENT DOCUMENTS

| | | | |
|---|---|---|---|
| 3,300,216 | 1/1967 | Haecker . | |
| 3,894,736 | 7/1975 | Foley . | |
| 4,561,660 | 12/1985 | Zammuto | 273/376 |
| 4,635,940 | 1/1987 | Kelley | 273/376 X |
| 4,651,998 | 3/1987 | Holt et al. | 273/347 |
| 4,804,193 | 2/1989 | Lin et al. | 273/376 |
| 4,836,556 | 6/1989 | DeVale et al. | 273/376 |
| 4,982,968 | 1/1991 | Foley . | |
| 5,193,817 | 3/1993 | Pan . | |
| 5,197,743 | 3/1993 | Hanson . | |
| 5,275,418 | 1/1994 | Yiu | 273/376 |

FOREIGN PATENT DOCUMENTS

| | | | |
|---|---|---|---|
| 2643228 | 3/1978 | Germany | 273/347 |
| 3900137 | 7/1990 | Germany . | |
| 4302490 | 9/1993 | Germany . | |
| 817552 | 7/1959 | United Kingdom . | |
| 1020847 | 2/1966 | United Kingdom . | |
| 1532744 | 11/1978 | United Kingdom | 273/376 |
| 2130107 | 5/1984 | United Kingdom | 273/376 |

*Primary Examiner*—Paul E. Shapiro

*Attorney, Agent, or Firm*—Law Office of Steven M. Rabin

[57] ABSTRACT

A dart board assembly including a cover frame, a back frame fastened to the cover frame, a plurality of target plates fitted into respective radial scoring open areas in the cover frame, a membrane circuit mounted between the target plates and the back frame, a printed circuit board insulated from the membrane circuit by a slotted insulative partition board, wherein each target plate is fixedly attached with a respective rigid insulative plate and supported on a respective cushion for quick return after a striking, the rigid insulative plate having a plurality of contact pins inserted into respective through holes and suspended from the membrane circuit by a gap for triggering the membrane circuit upon striking of the dart.

8 Claims, 6 Drawing Sheets

DART BOARD ASSEMBLY

BACKGROUND OF THE INVENTION (a) Field of the Invention

The present invention relates to dart boards, and relates more particularly to a dart board assembly which has means to automatically push the target plate away from the membrane circuit after each striking.

(b) Description of the Prior Art

A variety of dart boards have been disclosed for play with different darts, and have appeared on the market. U.S. Pat. No. 5,193,817 discloses a dart board, which includes a base plate, a target frame fixed to the base plate, and an automatic scoring register mounted between the target frame and the base plate. The target frame has a target portion including a plurality of target plates formed with blind counterbores for receiving the dart when the dart strikes the target portion. The drawback of this structure of dart board is that it is not suitable for use in an official game. U.S. Pat. No. 3,894,736 discloses another structure of dart board which comprises a board member having a plurality of protruding pegs arranged in a closely spaced relationship. The dart for this structure of dart board is of size to frictionally fit between the pegs on the board member. Because the board member is molded from polyethylene, it is flexible and tends to deform. When the dart is frictionally fits between the pegs on the board member, the board member tends to be formed, causing the respective contact pins to constantly contact the membrane circuit. When this situation happens, the circuit cannot be reset automatically for a next scoring operation.

SUMMARY OF THE INVENTION

The present invention has been accomplished under the circumstances in view. According to one embodiment of the present invention, the dart board assembly comprises a cover frame, a back frame fastened to the cover frame, a plurality of target plates fitted into respective radial scoring open areas in the cover frame, a membrane circuit mounted between the target plates and the back frame, a printed circuit board insulated from the membrane circuit by a slotted insulative partition board, wherein each target plate is fixedly attached with a respective rigid insulative plate and supported on a respective cushion for quick return after a striking, the rigid insulative plate having a plurality of contact pins inserted into respective through holes and suspended from the membrane circuit by a gap for triggering the membrane circuit upon striking of the dart. According to another aspect of the present invention, rubber cones are used and respectively mounted around each contact pin of the rigid insulative plate to replace the cushion in supporting the rigid insulative plate on the membrane circuit. According to still another aspect of the present invention, the rigid insulative plate is integrally molded on the back side of the target plate for quick installation. According to still another aspect of the present invention, each contact pin of the target plate comprises a bottom section for mounting a respective rubber cone, an intermediate section for mounting the membrane circuit and the insulative partition board and the printed circuit board, and a top section extended out of a hole on the printed circuit board and fixed up with an end cap. According to still another aspect of the present invention, the cover frame comprises a plurality of through holes around the radially slotted circular face panel, a plurality of back pins, a plurality of convex lenses respectively fastened to the back pins and fitted into the through holes on the cover frame and pairs of back pins, each convex lens having a plurality of mounting holes respectively fastened to respective back pins on the cover frame by welding.

DETAILED DESCRIPTION OF THE PREFERRED EMBODIMENT

Figure 1:
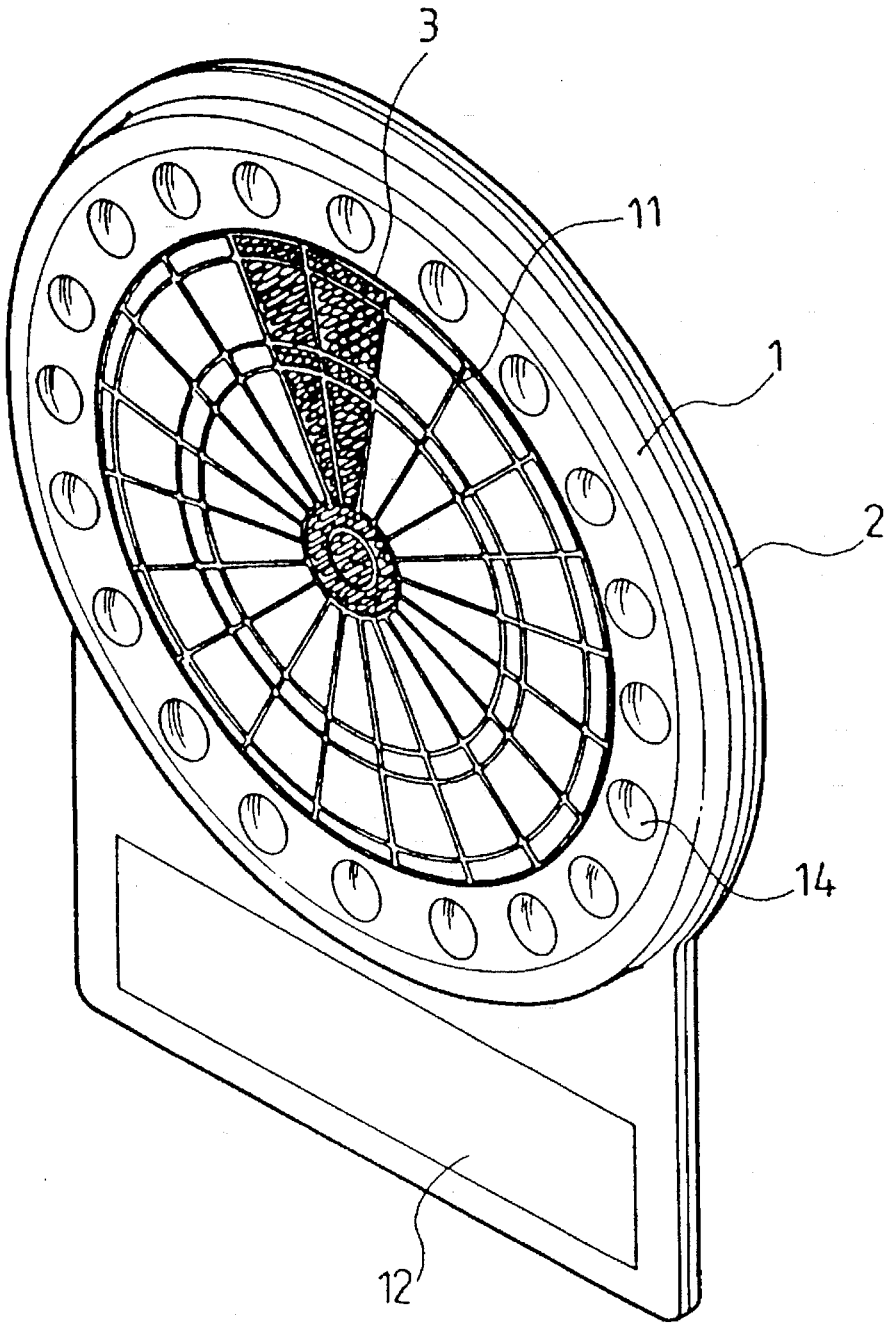
FIG. 1 is an elevational view of a dart board assembly according to the present invention.
Figure 2:
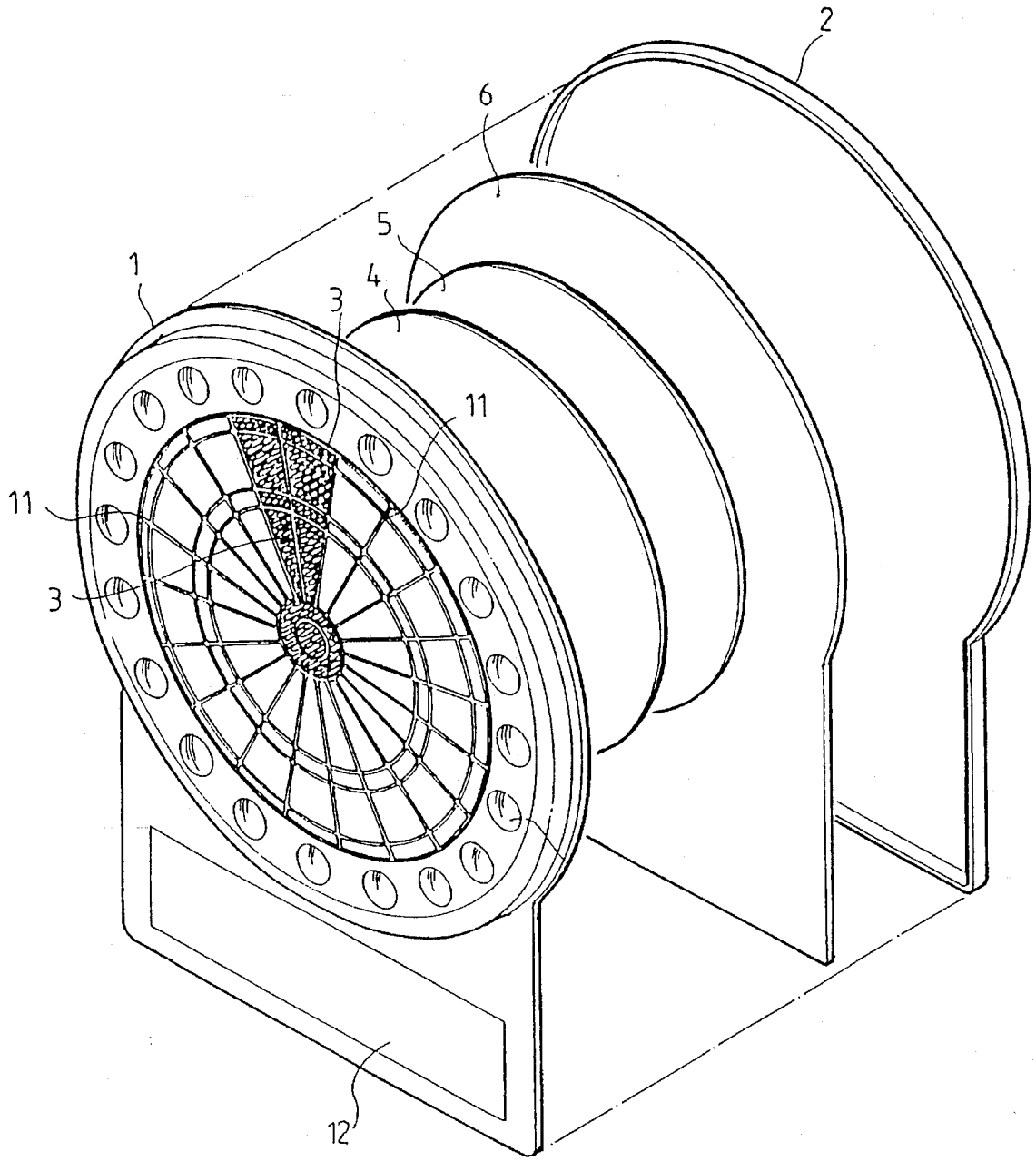
FIG. 2 is an exploded view of the dart board assembly shown in FIG. 1.

Referring to FIGS. 1 and 2, a dart board assembly in accordance with the present invention is generally comprised of a cover frame 1, a back frame 2, a plurality of target plates 3, a membrane circuit 4, an insulative partition board 5, and a printed circuit board 6. The cover frame 1 comprises a radially slotted circular face panel 11 at the center, and a scoring board 12 at the bottom. The radially slotted circular face panel 11 defines a plurality of radial scoring open areas of different scoring values. The back frame 2 is fastened to the back side of the cover frame 1 to hold the conductive membrane 4, the insulative partition board 5, and the printed circuit board 6 on the inside. The target plates 3 fit the scoring areas of the face panel 11 of the cover frame 1 respectively, each having a plurality of upright pegs 31 at the front side for holding the dart when the dart strikes the target plates 3 and a plurality of mounting rods 32 at the back side. The membrane circuit 4 is printed with an electric circuit for matching with the printed circuit board 6 to execute a scoring display work. The insulative partition board 5 is mounted between the membrane circuit 4 and the printed circuit board 6, having through holes 51 corresponding to respective contacts on the printed circuit board 6 for letting a respective contact on the printed circuit board 6 to be triggered when membrane circuit 4 is stricken by force. The printed circuit board 6 is printed with an electric circuit mounted with electronic components.

Figure 3:
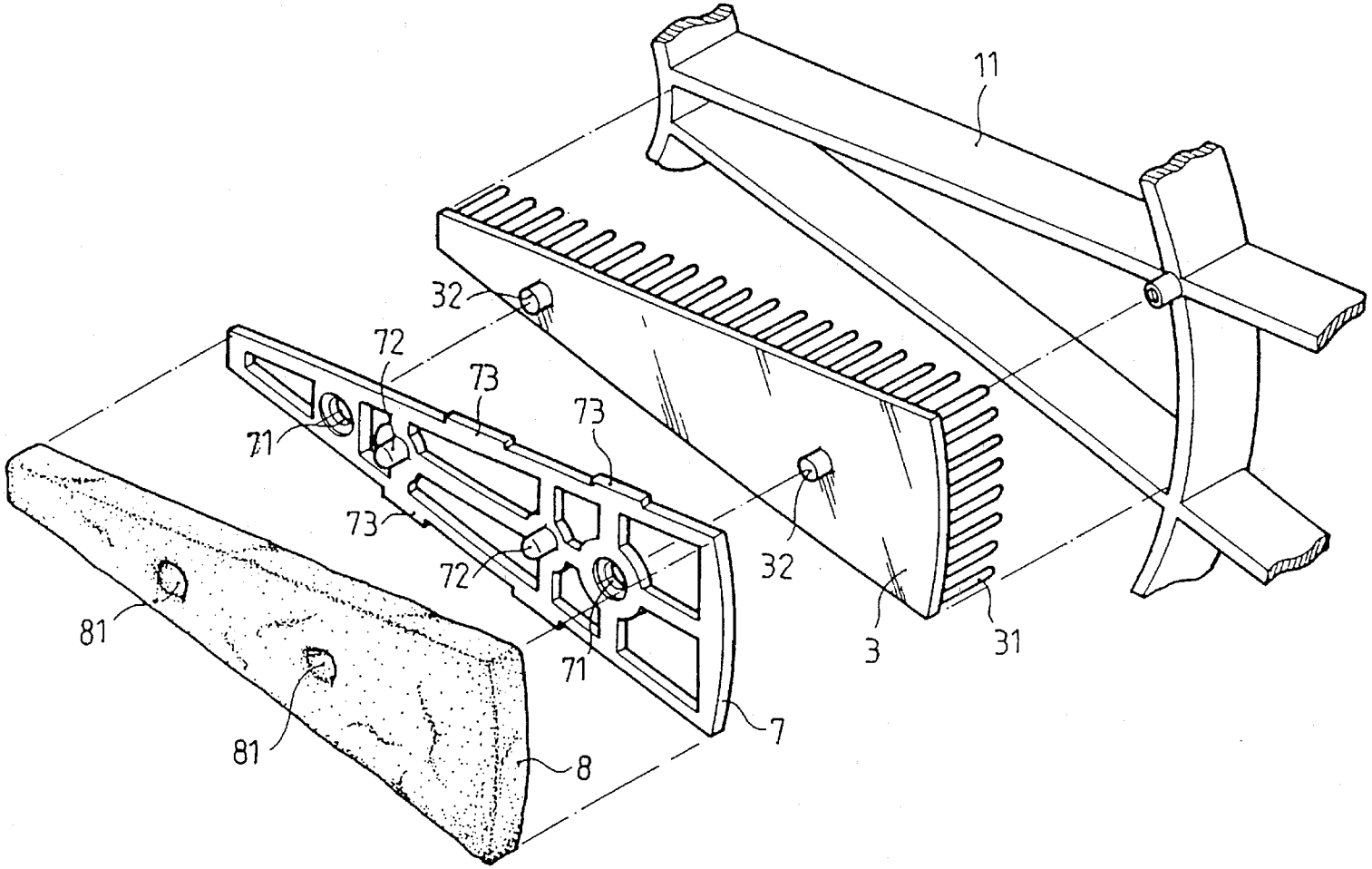
FIG. 3 is an exploded view of the radially slotted face panel, the target plate, the rigid insulative plate, and the cushion according to the present invention.
Figure 4:
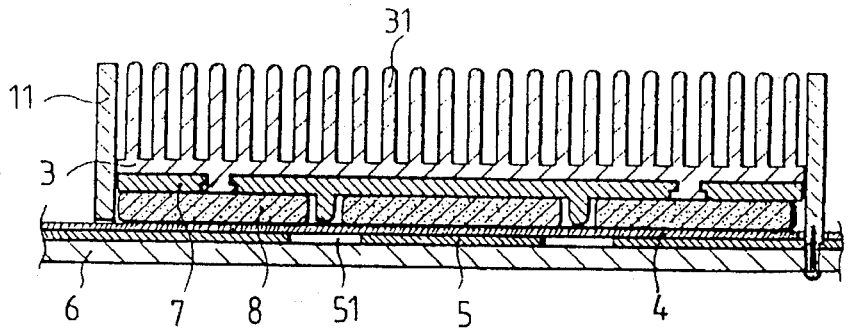
FIG. 4 is a sectional assembly view of FIG. 3.

Referring to FIGS. 3 and 4, each target plate 3 is attached with a rigid insulative plate 7 and a cushion 8. The rigid insulative plate 7 fits the back side of the corresponding target plate 3, having a plurality of mounting holes 71 for receiving the mounting rods 32 of the corresponding target plate 3, a plurality of contact pins 72 at the back side, and a plurality of retaining projections 73 at two opposite lateral sides. The rigid insulative plate 7 is preferably molded from plastics or Bakelite. In order to save material, the rigid insulative plate 7 can be made slotted. The cushion 8 is cut from sponge or foamed plastics subject to fit the back side of the corresponding rigid insulative plate 7, having a plurality of pin holes 81 for receiving the contact pins 72 of the corresponding rigid insulative plate 7. The depth of the pin holes 81 on the cushion 8 is slightly longer than the length of the contact pins 72 on the corresponding insulative plate 7. When the mounting rods 32 of one target plate 3 are respectively inserted into the mounting holes 71 on the respective rigid insulative plate 7, the mounting rods 32 are respectively fixed to the mounting holes 71 by a welding process. When the target plates 3 with the respective rigid insulative plates 7 are respectively fixed together, they are respectively fitted into the radial scoring open areas defined within the radially slotted circular face panel 11, permitting the retaining projections 73 to be engaged with the face panel 11, and then the cushions 8 are respectively fastened to the respective rigid insulative plates 7. When the target plates 3 with the rigid insulative plates 7 and the cushions 8 are installed, the membrane circuit 4, the insulative partition board 5, and the printed circuit board 6 are respectively attached together and then attached to the back side of the cushions 8, and then the back frame 2 is fixed to the cover frame 1 to finish the assembly process. Because the target plates 3 are supported on the rigid insulative plates 7, they do not deform when they receive the dart or the dart is pulled away from the target plates 3. Because the depth of the pin holes 81 is slightly longer than the length of the contact pins 72 of the rigid insulative plates 7, the contact pins 72 are spaced from the membrane circuit 4 by a narrow gap when they are respectively inserted into the pin holes 81 on the cushions 8. When the dart strikes one target plate 7 to force the respective contact pins 71 into contact with the membrane circuit 4, the membrane circuit 4 immediately triggers the corresponding contact on the printed circuit board 6. Immediately after an electric contact is made, the cushion 8 returns to its former shape, causing the respective target plate 7 moved back to its former position for a nest striking operation.

Figure 6:
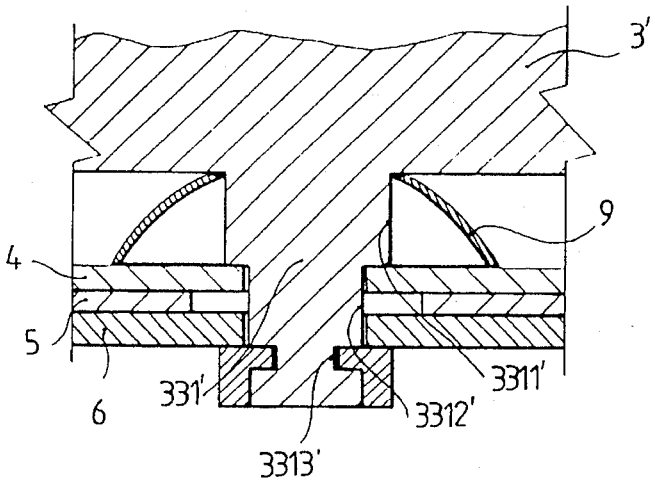
FIG. 6 is a sectional assembly view of FIG. 5.
Figure 5:
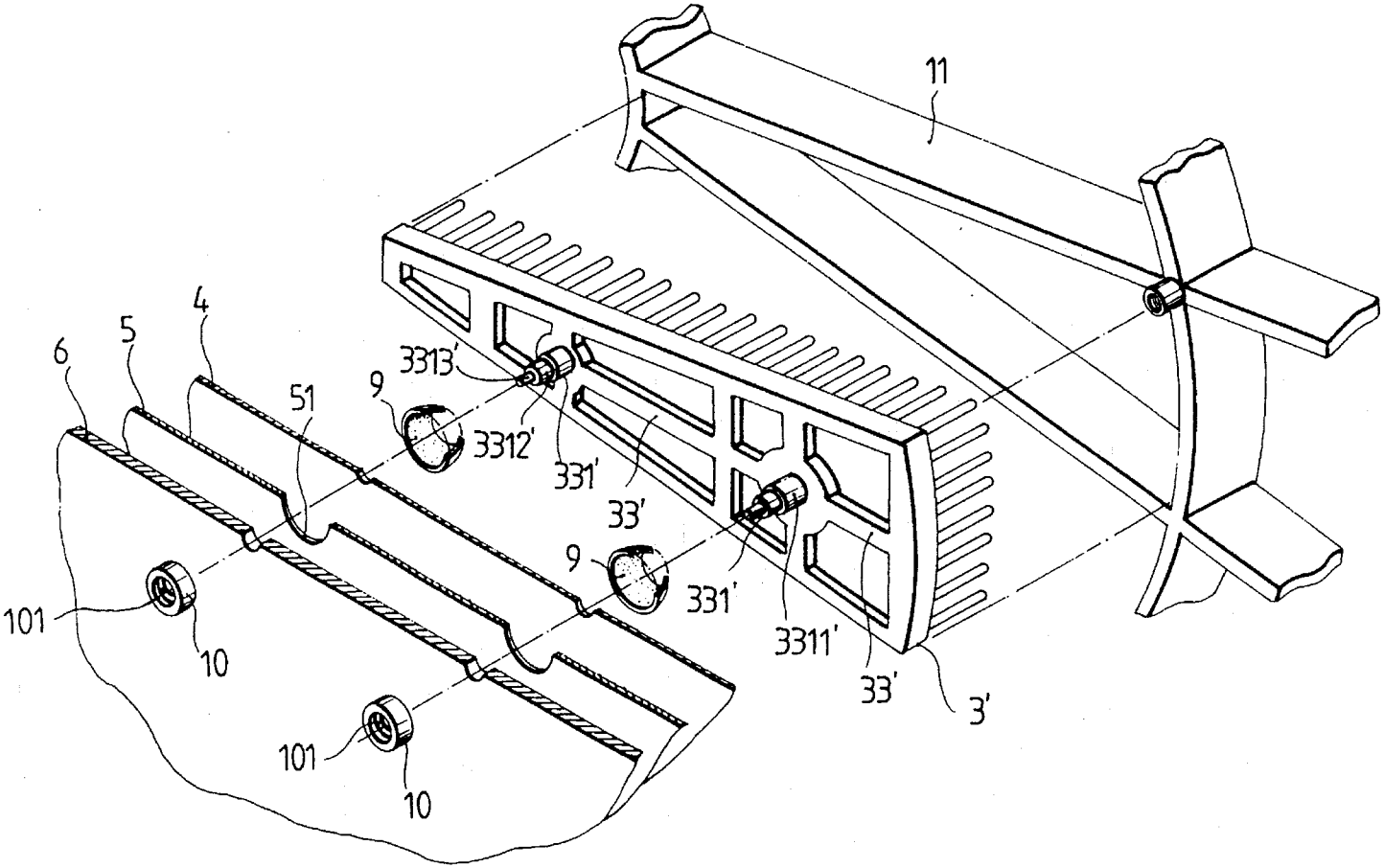
FIG. 5 is an exploded view of an alternate form of the present invention.

FIGS. 5 and 6 show an alternate form of the present invention. The target plate 3' comprises a plurality of reinforcing ribs 33' at the back side to prevent deformation, a plurality of stepped contact pins 331' raised from the reinforcing ribs 33', a plurality of rubber cones 9 respectively mounted around the stepped contact pins 331' and stopped at the membrane circuit 4. Each stepped contact pin 331' of the target plate 3' comprises a bottom section 3311' for mounting one rubber cone 9, an intermediate section 3312' for mounting the membrane circuit 4 and the insulative partition board 5 and the printed circuit board 6, and a top section 3313' extended out of the printed circuit board 6 and fixed up with a respective end cap 10. Alternatively, the aforesaid cushions 8 may be used to replace the rubber cones 9. The end cap 10 has a welding hole 101. When the top section 3313' is inserted through a respective hole on the printed circuit board and attached with a respective end cap 10, the end cap 10 is sealed to the top section 3313' by welding.

Figure 8:
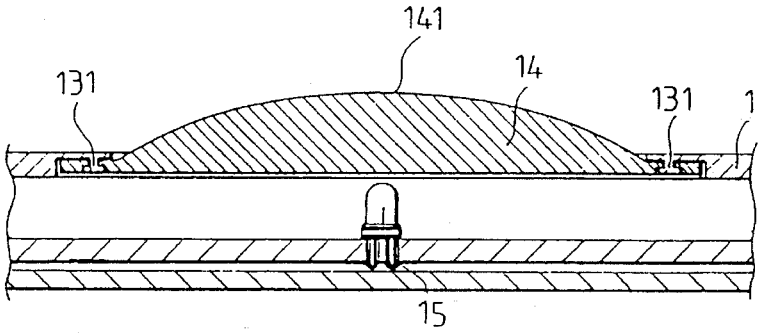
FIG. 8 is a sectional assembly view of FIG. 7.
Figure 7:
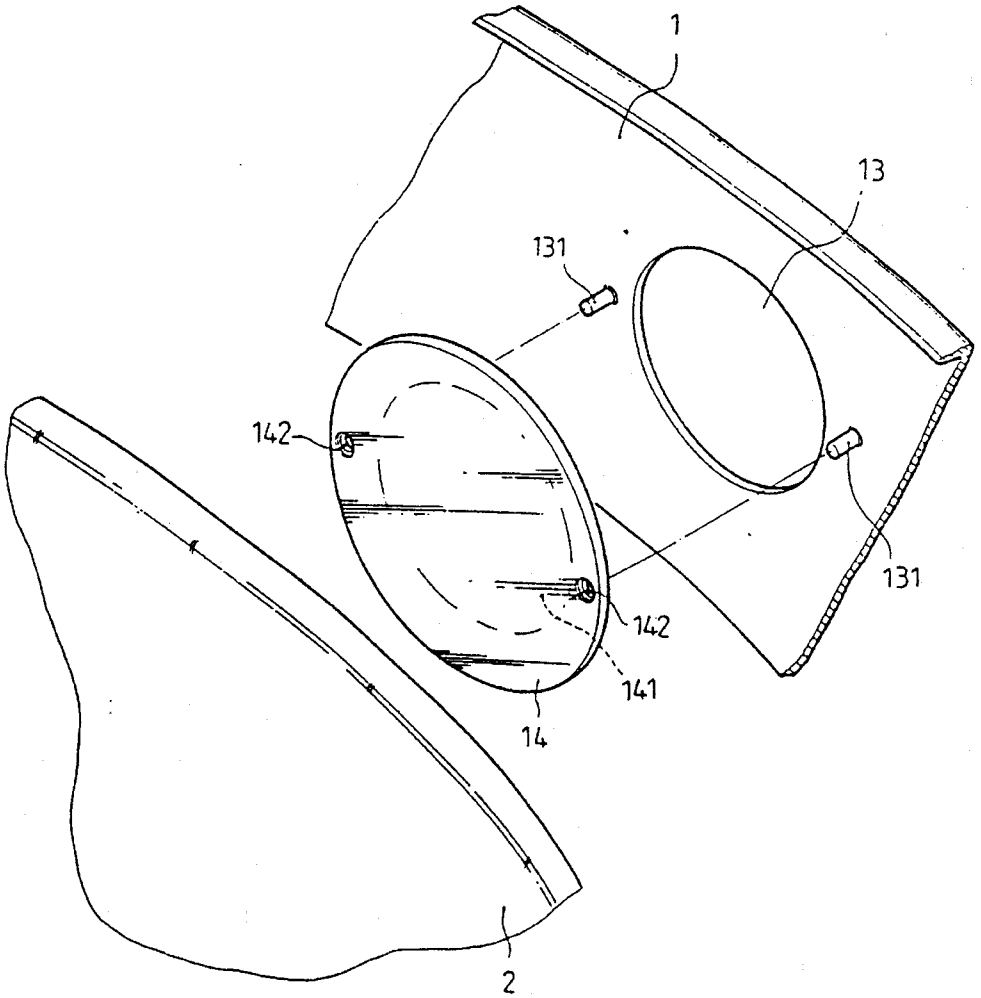
FIG. 7 is a dismantled view of a convex lens and the cover frame according to the present invention.

Referring to FIGS. 7 and 8, the cover frame 1 has a plurality of through holes 13 around the radially slotted circular face panel 11 corresponding to a respective light emitting diode 15, and pairs of back pins 31 respectively disposed at two opposite sides by each through hole 13 for mounting a respective lens 14. The lens 14 has two opposite mounting holes 142 respectively fastened to one pair of back pins 31 by welding, and a convex face 141 printed with a respective scoring value and fitted into the respective through hole 13 on the cover frame 1.

We claim:

1. A dart board assembly comprising:

a cover frame having a radially slotted circular face panel at the center, and a scoring board at a lower side, said radially slotted circular face panel defining a plurality Of radial scoring open areas of different scoring values;

a back frame fastened to said cover frame at a back side;

a plurality of target plates respectively fitted into the radial scoring open areas on said face panel of said cover frame, each target plate comprising a plurality of upright pegs raised from a front side thereof for receiving the dart and a plurality of mounting rods raised from a back side thereof;

a membrane circuit mounted between said target plates and said back frame;

a printed circuit board mounted between said membrane circuit and said back frame to act with said membrane circuit in executing a scoring display work;

an insulative partition board mounted between said membrane circuit and said printed circuit board;

wherein each target plate is attached with a respective rigid insulative plate and a respective cushion, said rigid insulative plate fitting the back side of the respective target plate, having a plurality of mounting holes respectively fastened to the mounting rods on the respective target plate by welding, at least one contact pin at a back side thereof for triggering said membrane circuit, said cushion being supported between said rigid insulative plate and said membrane circuit and having at least one through holes, which receives the at least one contact pin of said rigid insulative plate respectively, the depth of the at least one through hole on said cushion being longer than the length of the at least one contact pin of said rigid insulative plate.

2. The dart board assembly of claim 1 wherein said rigid insulative plate is slotted, having a plurality of retaining projections at two opposite lateral sides respectively fastened to said radially slotted circular face panel of said cover frame.

3. The dart board assembly of claim 1 wherein said cushion is made from sponge.

4. The dart assembly of claim 1 wherein said cover frame comprises a plurality of through holes around said radially slotted circular face panel, a plurality of back pins, a plurality of convex lenses respectively fastened to the back pins and fitted into the through holes on said cover frame and pairs of back pins, each convex lens having a plurality of mounting holes respectively fastened to respective back pins on said cover frame by welding.

5. A dart board assembly comprising:

a cover frame having a radially slotted circular face panel at the center, and a scoring board at a lower side, said radially slotted circular face panel defining a plurality of radial scoring open areas of different scoring values;

a back frame fastened to said cover frame at a back side;

a plurality of target plates respectively fitted into the radial scoring open areas on said face panel of said cover frame, each target plate comprising a plurality of upright pegs raised from a front side thereof for receiving the dart;

a membrane circuit mounted between said target plates and said back frame;

a printed circuit board mounted between said membrane circuit and said back frame to act with said membrane circuit in executing a scoring display work;

an insulative partition board mounted between said membrane circuit and said printed circuit board;

wherein each target plate comprises a plurality of reinforcing ribs at a back side thereof and at least one contact pin raised from said reinforcing ribs and suspended from said membrane circuit by a respective rubber cone, said rubber cone being mounted around one contact pin of said target plates for returning the respective target plate after each striking by the dart.

6. The dart assembly of claim 5 wherein each contact pin of said target plates comprises a bottom section for mounting a respective rubber cone, an intermediate section for mounting said membrane circuit and said insulative partition board and said printed circuit board, and a top section extended out of a hole on said printed circuit board and fixed up with an end cap.

7. The dart assembly of claim 6 wherein said top section is fixed to said end cap by welding.

8. A dart board assembly comprising:

a cover frame having a radially slotted circular face panel at the center, and a scoring board at a lower side, said radially slotted circular face panel defining a plurality of radial scoring open areas of different scoring values;

a back frame fastened to said cover frame at a back side;

a plurality of target plates respectively fitted into the radial scoring open areas on said face panel of said cover frame, each target plate comprising a plurality of upright pegs raised from a front side thereof for receiving the dart;

a membrane circuit mounted between said target plates and said back frame;

a printed circuit board mounted between said membrane circuit and said back frame to act with said membrane circuit in executing a scoring display work;

an insulative partition board mounted between said membrane circuit and said printed circuit board;

wherein said target plates are respectively supported on said membrane circuit by a respective cushion, each target plate comprising a plurality of reinforcing ribs at a back side thereof and at least one contact pin raised from said reinforcing ribs and inserted into a respective through hole on the respective cushion, the length of the at least one contact pin of said target plates being shorter than the depth of the through holes on each cushion.

* * * * *